US008121514B2

(12) United States Patent
Kim et al.

(10) Patent No.: US 8,121,514 B2
(45) Date of Patent: Feb. 21, 2012

(54) DEVELOPING DEVICE AND IMAGE FORMING APPARATUS EMPLOYING THE SAME

(75) Inventors: Jong-in Kim, Suwon-si (KR); Min-sik Ji, Seoul (KR); Jai-il Choi, Suwon-si (KR); Dong-cheol Ahn, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 167 days.

(21) Appl. No.: 12/730,456

(22) Filed: Mar. 24, 2010

(65) Prior Publication Data

US 2011/0002708 A1 Jan. 6, 2011

(30) Foreign Application Priority Data

Jul. 3, 2009 (KR) ..... 2009-60838

(51) Int. Cl.
*G03G 15/08* (2006.01)

(52) U.S. Cl. ..... 399/103; 399/106

(58) Field of Classification Search ..... 399/102, 399/103, 105, 106, 119
See application file for complete search history.

(56) References Cited

U.S. PATENT DOCUMENTS 6,101,348 A * 8/2000 Nonaka et al. ..... 399/103
2002/0098007 A1 7/2002 Chadani

FOREIGN PATENT DOCUMENTS

JP 03-279983 12/1991
JP 07-077864 3/1995
JP 2006-259343 9/2006

OTHER PUBLICATIONS

Extended European Search Report issued Oct. 28, 2010 in EP Application No. 10167302.8.
Korean Office Action issued Jul. 11, 2011 in KR Application No. 10-2009-0060838.

* cited by examiner

*Primary Examiner* — Hoang Ngo
(74) *Attorney, Agent, or Firm* — Stanzione & Kim, LLP

(57) ABSTRACT

A developing device has a housing including a toner container containing toner, and a developing unit. The developing unit includes a developing roller and a photoconductive drum, and a barrier member including a toner supply window. The barrier member is combined with the housing to separate the toner container and the developing unit from each other. The developing unit also includes a blocking film that is attached to the barrier member to block the toner supply window. An end of the blocking film is exposed outside the housing through an opening formed in a sidewall of the housing. A bottom surface and first and second side surfaces of the barrier member are attached to a bottom surface and first and second side surfaces of the housing by using a welding process, and a distance between the first and second side surfaces of the barrier member and a distance between the first and second side surfaces of the housing increase from bottom to top.

20 Claims, 10 Drawing Sheets

DEVELOPING DEVICE AND IMAGE FORMING APPARATUS EMPLOYING THE SAME

CROSS-REFERENCE TO RELATED APPLICATIONS

This application claims priority under Korean Patent Application No. 10-2009-0060838, filed on Jul. 3, 2009, in the Korean Intellectual Property Office, the disclosure of which is incorporated herein in its entirety by reference.

BACKGROUND

1. Field of the Invention

One or more embodiments of the present general inventive concept relate to a developing device and an electrophotographic image forming apparatus employing the development device.

2. Description of the Related Art

Electrophotographic image forming apparatuses print an image on a recording medium by irradiating light, which is modulated to correspond to image information, onto a photoconductor in order to form an electrostatic latent image on a surface of the photoconductor, supplying toner to the electrostatic latent image in order to develop the electrostatic latent image into a visible toner image, and then, transferring and fixing the toner image onto the recording medium. Electrophotographic image forming apparatuses include a developing device containing toner.

The photoconductor and the toner may be provided via a cartridge which may be referred to as a 'developing device'. When the toner contained in the developing device is completely consumed, the developing device is removed from the electrophotographic image forming apparatus, and a new developing device is inserted into the electrophotographic image forming apparatus.

A developing device may be divided into a toner container and a developing unit. Before the developing device is inserted into an image forming apparatus, the toner container and the developing unit are isolated from each other by disposing a blocking film therebetween. The blocking film is removed in order to connect the toner container and the developing unit with each other before the developing device is inserted into the image forming apparatus. When the toner container is not completely isolated from the developing unit, toner may leak to the developing unit during delivery of the developing device. If toner leaks to the developing unit, it may be difficult to remove the blocking film.

SUMMARY

One or more embodiments of the present general inventive concept provide a developing device in which toner contained in a toner container is prevented from leaking to the developing unit, and an electrophotographic image forming apparatus employing the same.

One or more embodiments of the present general inventive concept also provide a developing device in which a blocking film disposed between a toner container and a developing unit is easily removed, and an electrophotographic image forming apparatus employing the same.

Additional aspects and utilities of the present general inventive concept will be set forth in part in the description which follows and, in part, will be obvious from the description, or may be learned by practice of the general inventive concept.

Features and/or utilities of the present general inventive concept may be realized by a developing device including a housing including a toner container containing toner, and a developing unit, wherein the developing unit includes a developing roller and a photoconductive drum; a barrier member including a toner supply window, wherein the barrier member is combined with the housing to separate the toner container and the developing unit from each other; and a blocking film that is attached to the barrier member to block the toner supply window, wherein an end of the blocking film is exposed outside the housing through an opening formed in a sidewall of the housing, wherein a bottom surface and first and second side surfaces of the barrier member are attached to a bottom surface and first and second side surfaces of the housing by using a welding process, and a distance between the first and second side surfaces of the barrier member and a distance between the first and second side surfaces of the housing increase from bottom to top.

The first and second side surfaces of the barrier member may be disposed at an angle of about 75 to about 81 degrees with respect to a horizontal plane.

The developing device may further include a plurality of fusion protrusions protruding from the bottom surface and the first and second side surfaces of the barrier member, and fusion grooves formed in the bottom surface and the first and second side surfaces of the housing, into which the plurality of fusion protrusions are inserted. An overlapping distance, constituting a measure of how much the fusion protrusions overlap the fusion grooves, respectively, may be about 0.3 to about 0.5 mm.

The blocking film may be attached to an attachment surface of the barrier member, the attachment surface facing the developing unit.

A lower end of the toner supply window may be disposed to be higher than a bottom surface of the developing unit. The developing unit may include a supply roller attaching toner to the developing roller, and the lower end of the toner supply window may be disposed to be higher than a center of the supply roller.

The barrier member may include a reinforcing rib having a multi-rib structure, the reinforcing rib being disposed on an upper portion of the toner supply window.

The barrier member may include a plurality of window reinforcement ribs crossing the toner supply window, wherein each of the window reinforcement ribs may be disposed such that an upper surface of each of the window reinforcement ribs is lower than the attachment surface, thereby forming a step between each of the window reinforcement ribs and the attachment surface.

A lower end of the opening may be disposed to be higher than a lower end of the toner supply window.

The developing device may include an elastic sealing unit that is combined with the sidewall of the housing in which the opening is formed, to cover the opening. A length of the sealing unit may be greater than a length of the opening. The developing device may further include a pressurizing unit pressing the sealing unit toward the sidewall of the housing. The housing may include a lower frame forming a lower frame of both the toner container and the developing unit; a receiving frame receiving remnant toner removed from the photoconductive drum; and a side frame that is combined with side surfaces of the lower frame and the receiving frame to connect the lower frame and the receiving frame, wherein the pressurizing unit is disposed at the side frame.

The housing may include a lower frame forming a lower structure of both the toner container and the developing unit; and an upper frame covering an upper portion of the lower frame, wherein a front end of the upper frame is fused with a top surface of the barrier member. A location at which the bottom surface of the barrier member is fused with the lower frame may be disposed closer to the toner container than a location at which the top surface of the barrier member is fused with the front end of the upper frame.

Features and/or utilities of the present general inventive concept may also be realized by an electrophotographic image forming apparatus including the developing device described above, an optical scanning unit scanning light, which is modulated according to an image signal, onto the photoconductive drum; a transfer device transferring a toner image formed on the photoconductive drum onto a recording medium; and a fixing unit fixing the toner image to the recording medium by applying heat and pressure to the recording medium.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1:
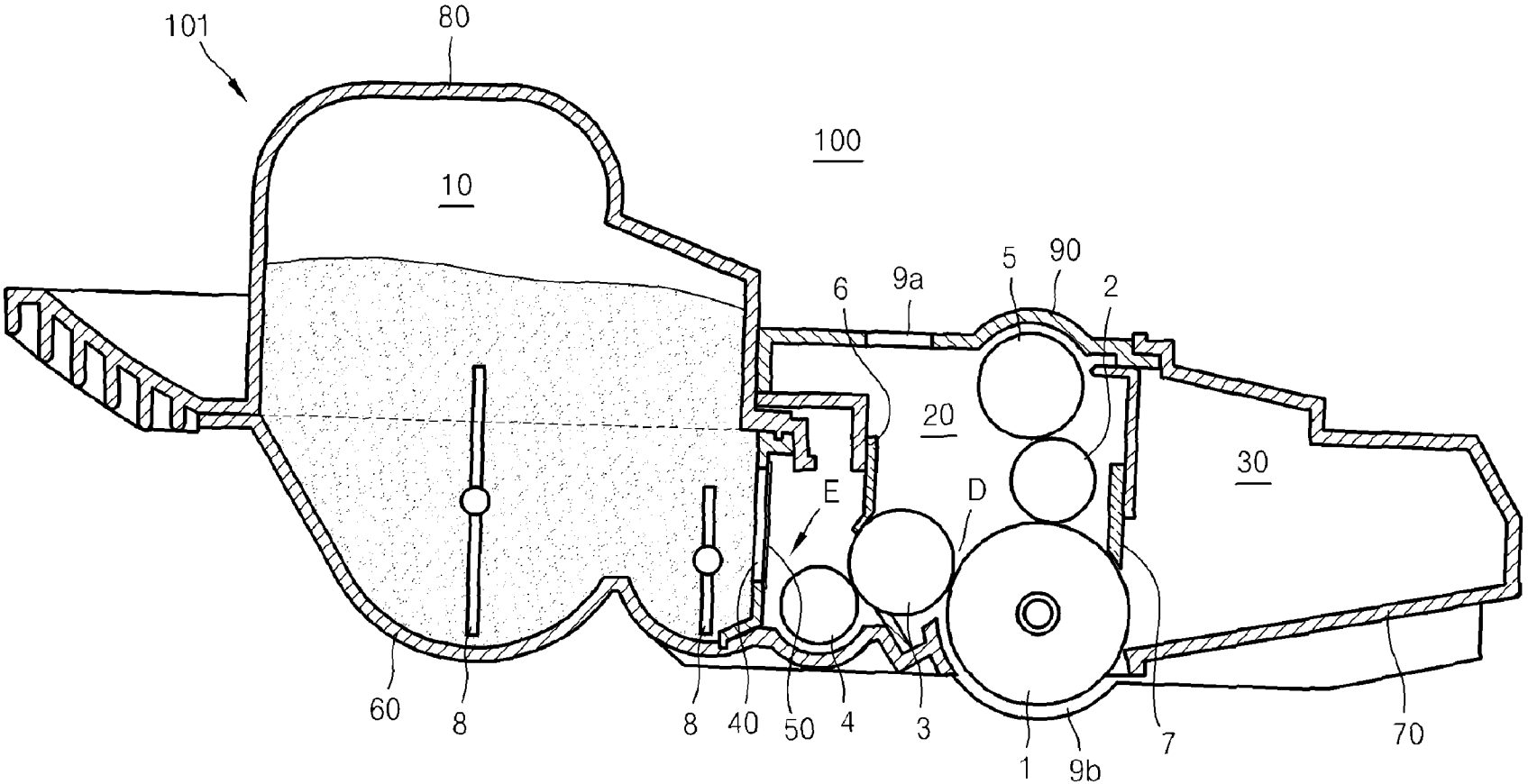
FIG. 1 is a schematic view showing the configuration of a developing device according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below to explain the present general inventive concept by referring to the figures.

Figure 2:
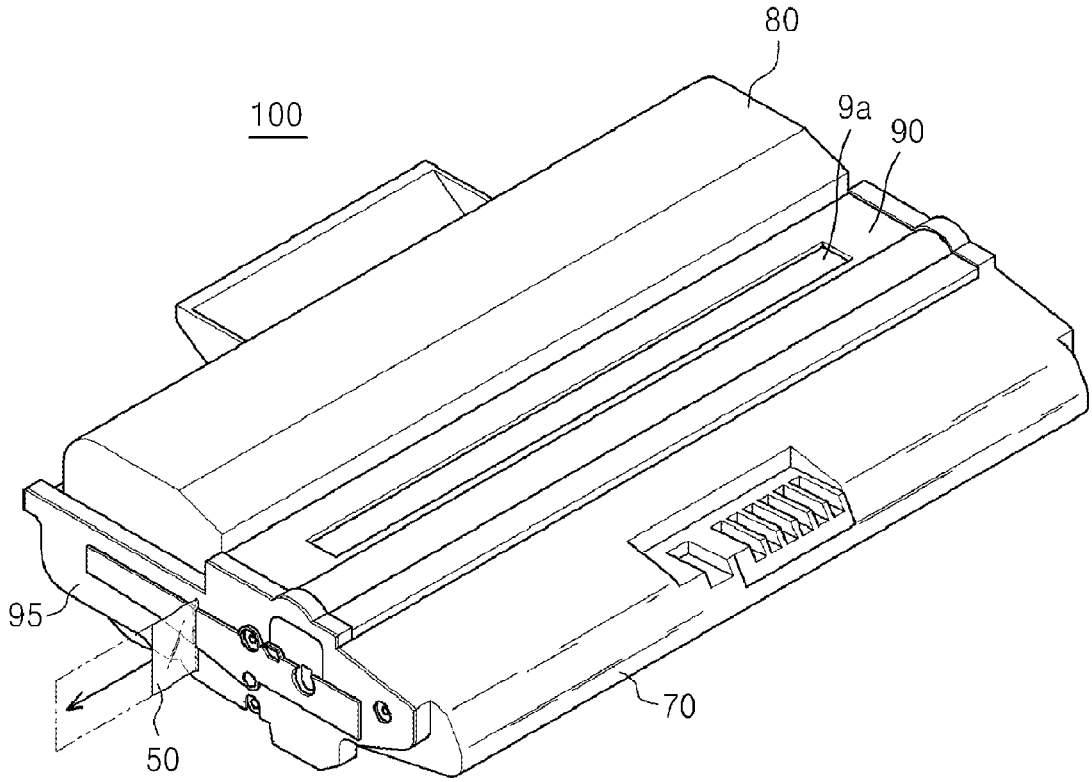
FIG. 2 is a perspective view of the developing device of FIG. 1.

FIG. 1 illustrates a configuration of a developing device 100 according to an embodiment of the present general inventive concept. FIG. 2 is a perspective view of the developing device illustrated in FIG. 1. Referring to FIGS. 1 and 2, the developing device 100 according to the present embodiment includes a housing 101 in which a toner container 10 and a developing unit 20 are installed. The housing 101 may further include a waste toner container 30. Toner that is to be used for a developing operation is contained in the toner container 10. The toner container 10 and the developing unit 20 are separated by a barrier member 40. A blocking film 50 is attached to the barrier member 40. If an end of the blocking film 50 that is exposed via a side portion of the developing device 100 is pulled before the developing device 100 is used, then the blocking film 50 is separated from the barrier member 40. When the blocking film 50 is completely removed, the toner container 10 and the developing unit 20 are connected, and thus the toner in the toner container 10 can be supplied to the developing unit 20.

The developing unit 20 includes a photoconductive drum 1, a charging roller 2, and a developing roller 3. The photoconductive drum 1 is manufactured by forming a photoconductive layer around an outer circumference of a cylindrical metal pipe. The charging roller 2 is an example of a charger that charges a surface of the photoconductive drum 1 to a uniform potential. A charging bias voltage is applied to the charging roller 2. A corona charger (not shown) may be used instead of the charging roller 2. The developing roller 3 supplies the toner from the toner container 10 to an electrostatic latent image formed on a surface of the photoconductive drum 1 in order to develop the electrostatic latent image. In the current embodiment, the developing device 100 employs a contact developing technique based on a principle that the developing roller 3 and the photoconductive drum 1 contact each other to form a developing nip D. In this case, the developing roller 3 may consist of an elastic layer (not shown) formed around an outer circumference of a conductive metal core (not shown). When a developing bias voltage is applied to the developing roller 3, the toner is transferred and attached to the electrostatic latent image, which is formed on the surface of the photoconductive drum 1, via the development nip D. If the developing device 100 employs a non-contact developing technique, a surface of the developing roller 3 and a surface of the photoconductive drum 1 are spaced about several hundreds of microns apart from each other. The development unit 20 may further include a supply roller 4 that attaches the toner supplied from the toner container 10 to the developing roller 3. A supply bias voltage may be applied to the supply roller 4 so as to attach the toner to the developing roller 3. Reference numeral 5 denotes a cleaning roller that removes foreign substances or toner attached to the charging roller 2. Reference numeral 6 denotes a regulator that regulates an amount of toner that is attached to a surface of the developing roller 3 to be supplied to the development nip D. Reference numeral 7 denotes a cleaning unit that removes remnant toner and foreign substances from a surface of the photoconductive drum 1 before charging is performed. The remnant toner and foreign substances removed from the photoconductive drum 1 via the cleaning unit 7 are contained in the waste toner container 30.

The toner container 10 may include an agitator 8 that supplies the toner to the development unit 20. The agitator 8 may agitate the toner contained in the toner container 10 in order to charge the toner to a predetermined electric potential. Although FIG. 1 illustrates two agitators 8, the present general inventive concept is not limited thereto. In the toner container 10, an appropriate number of agitators 8 may be installed at appropriate locations in order to effectively supply toner to the developing unit 20 in consideration of the capacity and shape of the toner container 10.

Referring to FIGS. 1 and 2, the housing 101 of the developing device 100 may include a lower frame 60, a receiving frame 70, an upper frame 80, and a cover 90. The lower frame 60 forms a lower frame of both the toner container 10 and the developing unit 20. The receiving frame 70 forms the waste toner container 30. The upper frame 80 covers an upper part of the toner container 10. The cover 90 covers an upper part of the developing unit 20. The cover 90 has an optical window 9*a* through which light irradiated by an optical scanning unit 200 of FIG. 13, which will be described in detail later, is incident on the photoconductive drum 1. A part of the photoconductive drum 1 is exposed to the outside via an aperture 9*b* formed in the bottom of the developing unit 20. The lower frame 60 and the receiving frame 70 may be connected to each other via a side frame 95.

Figure 3:
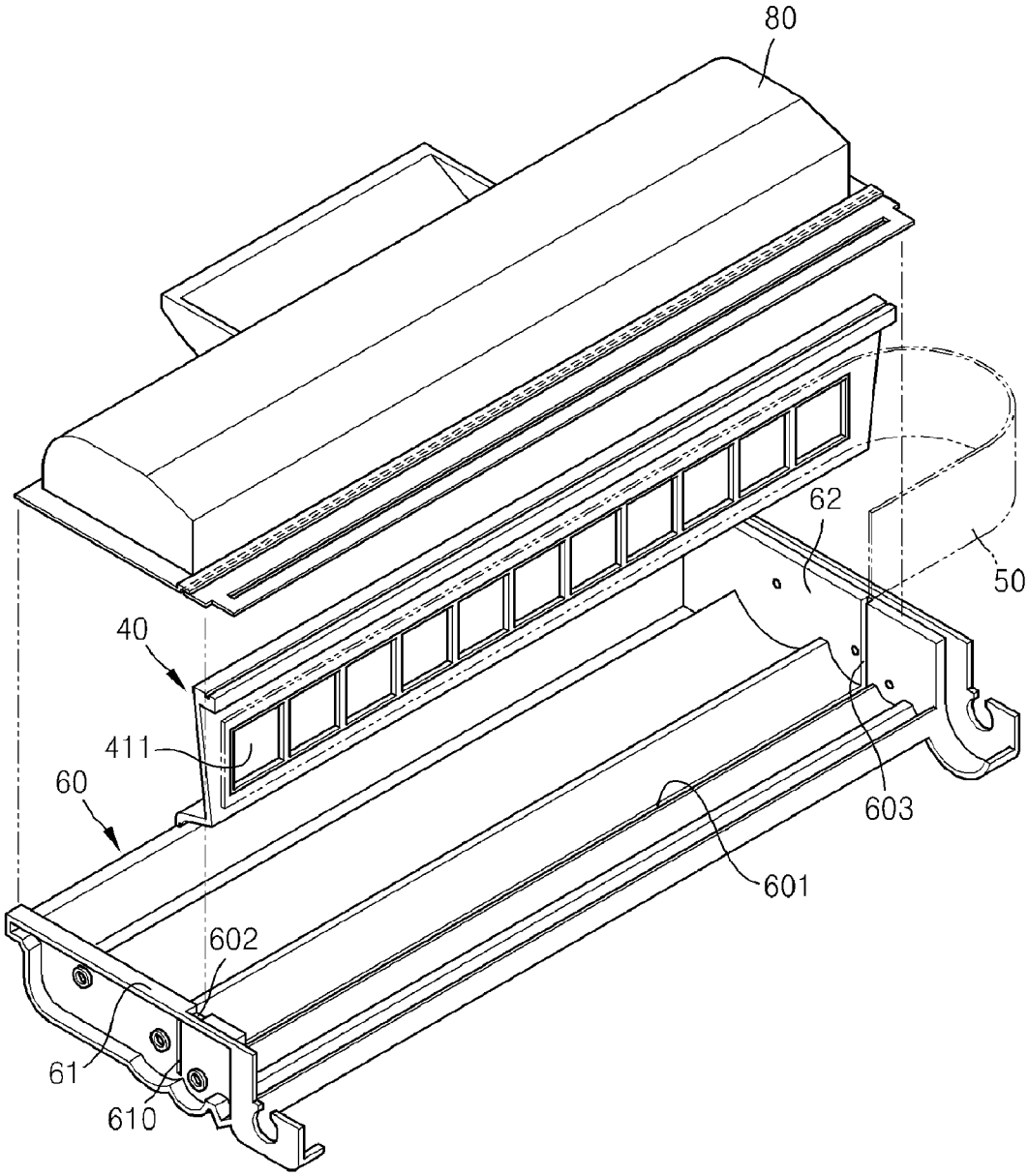
FIG. 3 is an exploded view illustrating how a lower frame, a barrier member, and an upper frame included in the developing device of FIG. 1 are combined with one another, according to an embodiment of the present general inventive concept.
Figure 4:
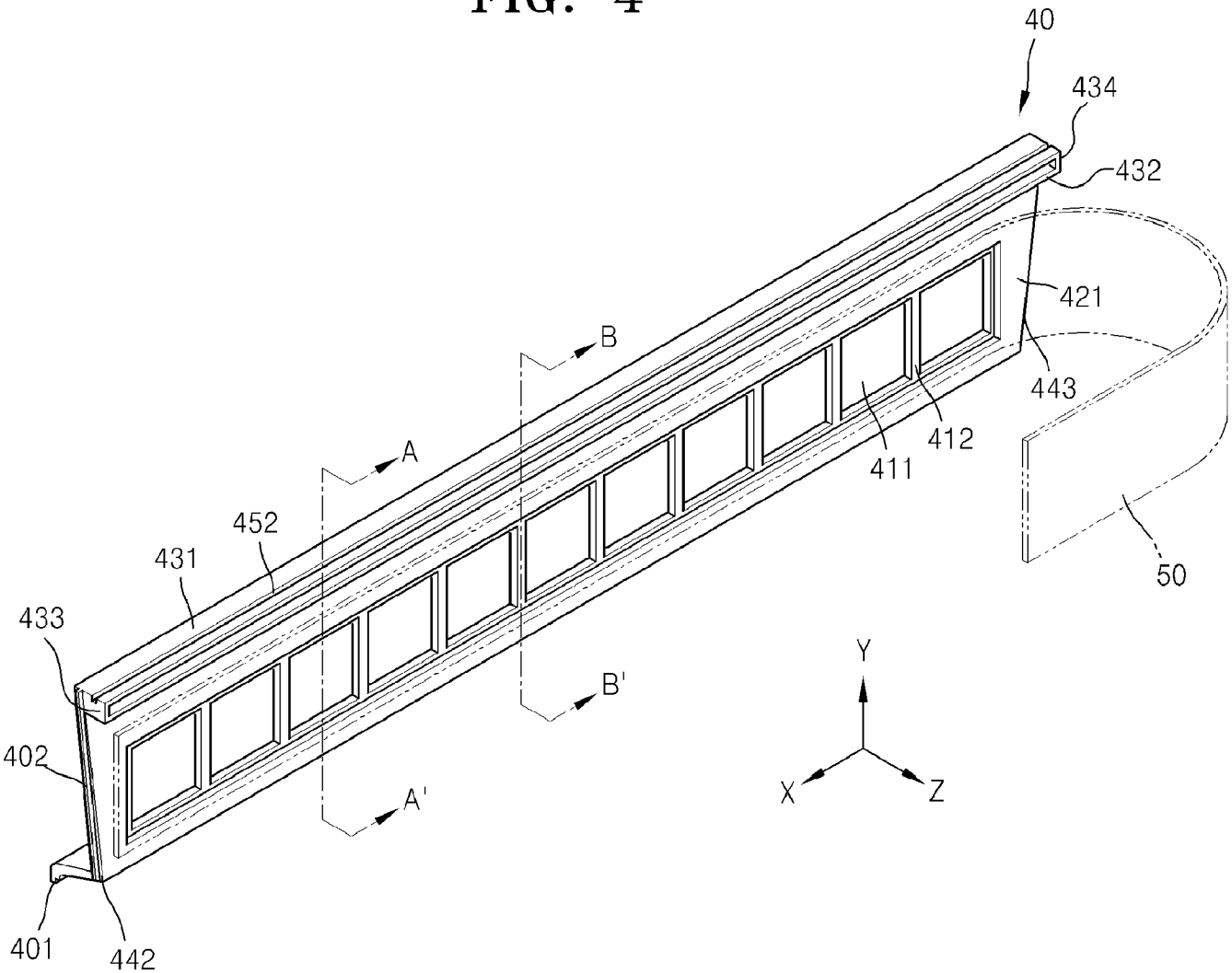
FIG. 4 is a perspective view of a barrier member included in the developing device of FIG. 1, according to an embodiment of the present general inventive concept.
Figure 5:
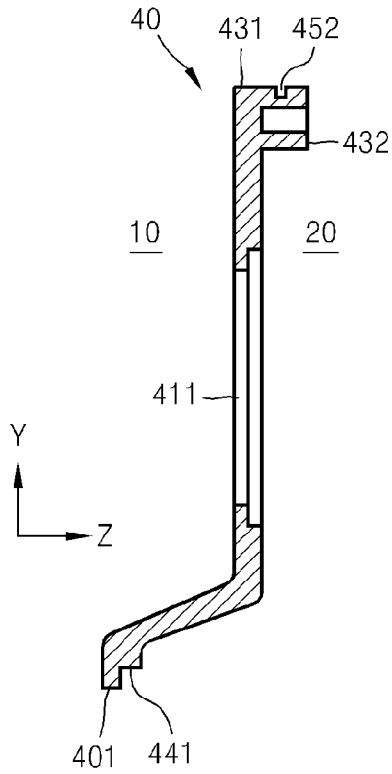
FIG. 5 is a cross-sectional view taken along a line A-A' of FIG. 4, according to an embodiment of the present general inventive concept.
Figure 6:
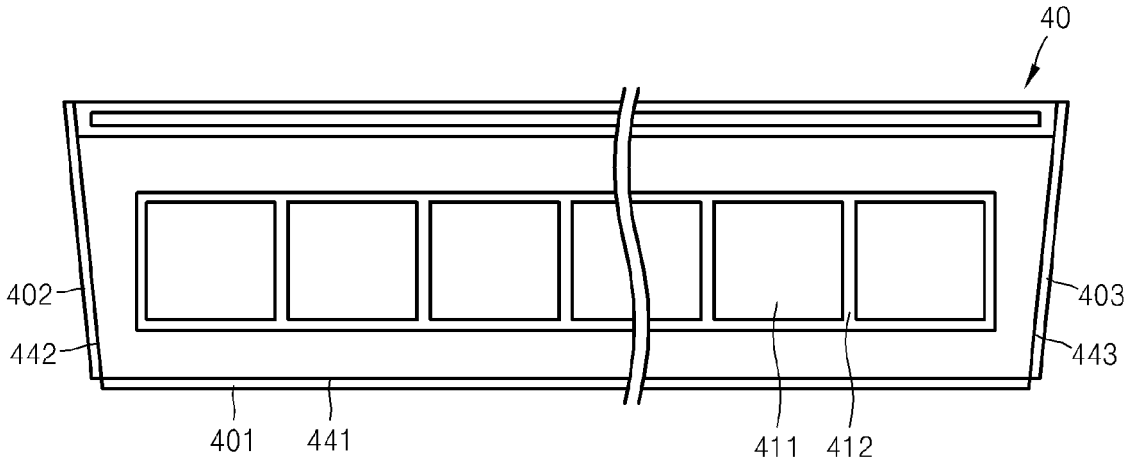
FIG. 6 is a front view of the barrier member included in the developing device of FIG. 1, according to an embodiment of the present general inventive concept.

FIG. 3 is an exploded view illustrating how the lower frame 60, the barrier member 40, and the upper frame 80 included in the developing device 100 are combined with one another, according to an embodiment of the present general inventive concept. FIG. 4 is a perspective view of the barrier member 40 included in the developing device 100, according to an embodiment of the present general inventive concept. FIG. 5 is a cross-sectional view taken along a line A-A' of FIG. 4, according to an embodiment of the present general inventive concept. FIG. 6 is a front view of the barrier member 40 included in the developing device 100, according to an embodiment of the present general inventive concept.

Referring to FIGS. 3 and 4, the blocking film 50 is attached to an attachment surface 421 of the barrier member 40, and the barrier member 40 is combined with the lower frame 60. The blocking film 50 blocks a toner supply window 411 of the barrier member 40. The barrier member 40 may be combined with the lower frame 60 by performing an ultrasonic welding process on the barrier member 40. To this end, as illustrated in FIGS. 4 to 6, a lower fusion protrusion 401 protrudes from a bottom surface 441 of the barrier member 40, and first and second side fusion protrusions 402 and 403 protrude from first and second side surfaces 442 and 443 of the barrier member 40, respectively. The lower fusion protrusion 401 extends along the bottom surface 441. The first and second side fusion protrusions 402 and 403 extend along the first and second side surfaces 442 and 443 of the barrier member 40, respectively. In the lower frame 60, a lower fusion groove 601 is formed, into which the lower fusion protrusion 401 is inserted. First and second fusion grooves 602 and 603 are respectively formed in first and second sidewalls 61 and 62 of the lower frame 60, into which the first and second fusion protrusions 402 and 403 are respectively inserted.

Figure 7:
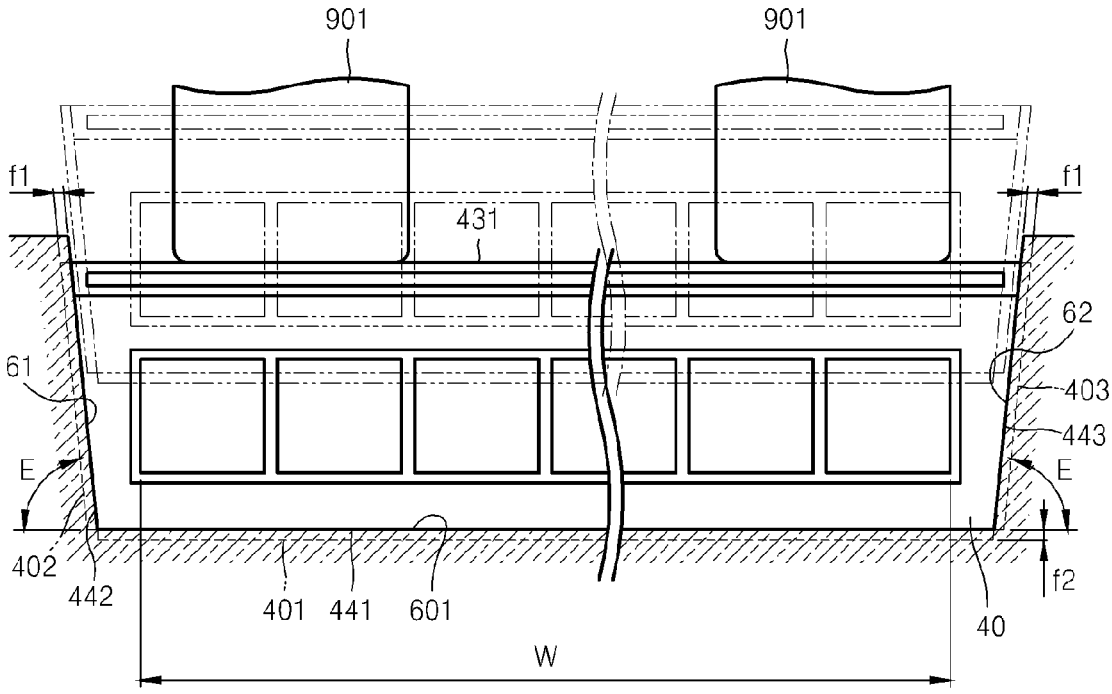
FIG. 7 is a front view for describing a process of fusing the barrier member of FIG. 1 with a lower frame.

As indicated by dotted lines in FIG. 7, the barrier member 40 is disposed on the lower frame 60 such that the first and second side fusion protrusions 402 and 403 of the barrier member 40 are inserted into the first and second side fusion grooves 602 and 603, respectively. Next, ultrasonic vibration is applied to the barrier member 40 while pressing a top surface 431 of the barrier member 40 with a fusion jig 901. Then, the first side fusion protrusions 402 and 403 are temporarily melted within the first and second side fusion grooves 602 and 603, and the barrier member 40 is moved downward along the first and second side fusion grooves 602 and 603. When the lower fusion protrusion 401 is inserted into the lower fusion groove 601, the lower fusion protrusion 401 is melted within the lower fusion groove 601. When the application of the ultrasonic vibration is stopped, the lower fusion protrusion 401 and the first and second side fusion protrusions 402 and 403 that are melted are hardened to be attached to the lower and first and second side fusion grooves 601 to 603. Thus, the barrier member 40 is combined with the lower frame 60. In this case, an overlapping distance f1, f2, representing a measure of how much the first and second side fusion protrusions 402 and 403 and the lower fusion protrusion 401 overlap first and second side fusion grooves 602, 603 and the lower fusion groove 601, respectively, may be between about 0.3 mm and about 0.5 mm. If the overlapping distance f is less than about 0.3 mm, then the barrier member 40 may not be firmly fused with the lower frame 60. If the overlapping distance f is greater than about 0.5 mm, then the fusion protrusions 401 to 403 may not be fully placed within the fusion grooves 601 to 603. The fusion jig 901 is used to press the top surface 431 of the barrier member 40. In this case, if the first and second side surfaces 442 and 443 of the barrier member 40 are perpendicular to a horizontal plane, then pressure is not applied by the fusion jig 901 between the first and second side fusion protrusions 402 and 403 and the first and second side fusion grooves 602 and 603, thereby preventing the barrier member 40 from being fused with the lower frame 60. According to one embodiment, not only the first and second side surfaces 442 and 443 of the barrier member 40 but also first and second sidewalls 61 and 62 of the lower frame 60 are inclined with respect to the horizontal plane by an angle E. That is, the distance between the first and second side surfaces 442 and 443 of the barrier member 40 and the distance between the first and second sidewalls 61 and 62 of the lower frame 60 increase from bottom to top. The angle E may be appropriately determined but if the angle E approaches 90 degrees, then the pressure applied between the first and second side fusion protrusions 402 and 403 and the first and second side fusion grooves 602 and 603 by the fusion jig 901 is insufficient, thereby preventing the barrier member 40 from being fused with the lower frame 60. Through experimentation, the maximum angle E that allows the barrier member 40 to be satisfactorily fused with the lower frame 60 was determined to be about 81 degrees. If the angle E is relatively small, the entire width of the developing device 100 should be increased in order to secure an effective supply width W of the plurality of toner supply windows 411 so that toner can be uniformly supplied to the entire surface of the developing unit 20. Through experimentation, the lower limit of the minimum angle E that allows the barrier member 40 to be satisfactorily fused with the lower frame 60 while minimizing an increase in the entire width of the developing device 100, was determined to be about 75 degrees. Accordingly, the angle E may range between about 75 degrees and about 81 degrees with respect to a horizontal plane.

As described above, the first and second side surfaces 442 and 443 of the barrier member 40 and the first and second sidewalls 61 and 62 of the lower frame 60 are determined to be inclined at the angle E with respect to a horizontal plane, thereby allowing the first and second side surfaces 442 and 443 of the barrier member 40 to be firmly fused with the first and second sidewalls 61 and 62 of the lower frame 60. When the first and second side surfaces 442 and 443 of the barrier member 40 are firmly fused with the first and second sidewalls 61 and 62 of the lower frame 60, it is possible to prevent the toner contained in the toner container 10 from leaking to the developing unit 20.

During fusing of the barrier member 40 with the lower frame 60, if the fusion jig 901 pressurizes the entire top surface 431 of the barrier member 40, then the barrier member 40 may be deformed. If the barrier member 40 is deformed, a part of the blocking film 50 may be separated from the attachment surface 421 of the barrier member 40. To prevent this, during the fusing operation, the fusion jig 901 applies pressure to only parts of the top surface 431 of the barrier member 40 that are adjacent to the first and second side surfaces 442 and 443 of the barrier member 40 instead of to the entire top surface 431 of the barrier member 40, as illustrated in FIG. 7. In this case, in order to reinforce the strength of the barrier member 40, the top surface 431 may further include an upper reinforcement rib 432. The upper reinforcement rib 432 may have a multi-rib structure that extends along a length direction x of the top surface 431 of the barrier member 40 as illustrated in FIGS. 4 and 5. Where a length direction of the barrier member 40 is represented by a symbol "x" and a height direction is represented by a symbol "y," the upper reinforcement rib 432 may extend from the planar surface of the barrier member 40 in a direction "z" perpendicular to the directions x and y. According to one embodiment, the upper reinforcement rib 432 has a double rib structure. Also, when first and second side surfaces 433 and 434 of the upper reinforcement rib 432 extend to the first and second side surfaces 442 and 443 of the barrier member 40, the barrier member 40 may be further reinforced and is better equipped to withstand pressure applied thereto by the fusion jig 901.

Referring to FIG. 4, the barrier member 40 includes the plurality of toner supply windows 411 for supplying the toner in the toner container 10 to the developing unit 20. The toner supply window 411 is a through-hole extending along the length direction of the barrier member 40. In order to prevent the plurality of toner supply windows 411 from deforming due to pressure applied by the fusion jig 901 during the fusing operation, a plurality of window reinforcement ribs 412 may be formed on the attachment surface 421 of the barrier member 40 crossing the toner supply window 411.

Figure 8:
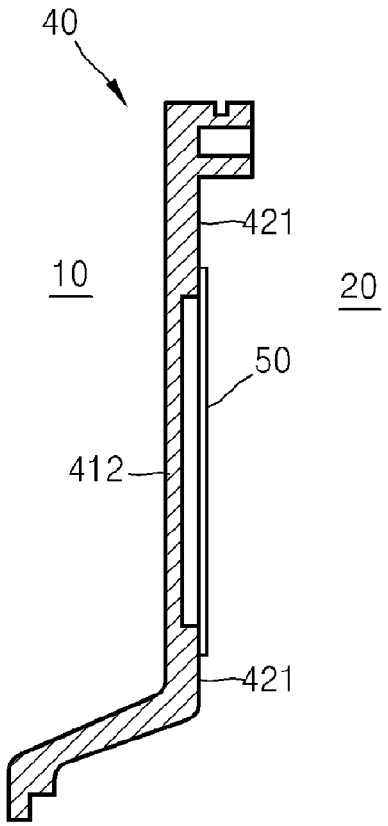
FIG. 8 is a cross-sectional view taken along a line B-B' of FIG. 4, according to an embodiment of the present general inventive concept.

Referring to FIG. 8, the blocking film 50 is placed on the attachment surface 421 of the barrier member 40 and is then heated in order to be attached to the barrier member 40. In this case, when the blocking film 50 is attached to not only the barrier member 40 but also the window reinforcement ribs 412, the blocking film 50 is securely attached to the barrier member 40 and thus cannot be easily separated from the barrier member 40. Accordingly, as illustrated in FIGS. 4 and 8, it is possible to prevent the plurality of window reinforcement ribs 412 from being attached to the blocking film 50 by forming the plurality of window reinforcement ribs 412 such that the upper surfaces of the plurality of window reinforcement ribs 412 are lower than that of the attachment surface 421 to form a step between the plurality of window reinforcement ribs 412 and the attachment surface 421.

Referring to FIG. 3, the first sidewall 61 of the lower frame 60 has an opening 610 through which an end of the blocking film 50 is exposed to the outside.

After the toner container 10 is filled with toner, the upper frame 80 is combined with the lower frame 60 and the barrier member 40. The upper frame 80 may be combined with the lower frame 60 and the barrier member 40 according to the ultrasonic welding process is performed on the barrier member 40. A plurality of fusion grooves (not shown) are formed at a bottom surface of the upper frame 80 to surround the toner container 10. Also, a plurality of fusion protrusions (not shown) are formed on the lower frame 60 to surround the lower frame 60 except for a region where the barrier member 40 is located. The top surface 431 of the barrier member 40 includes an upper fusion groove 452 into which a fusion protrusion (not shown) at a front end of the upper frame 80 and protruding toward the developing unit 20 is inserted. A location at which the lower frame 60 is fused with the bottom surface 441 of the barrier member 40 is closer to the toner container 10 than a location at which the front end of the upper frame 80 is fused with the top surface 431 of the barrier member 40. That is, the lower fusion protrusion 401 is closer to the toner container 10 than the upper fusion groove 452.

Figure 12:
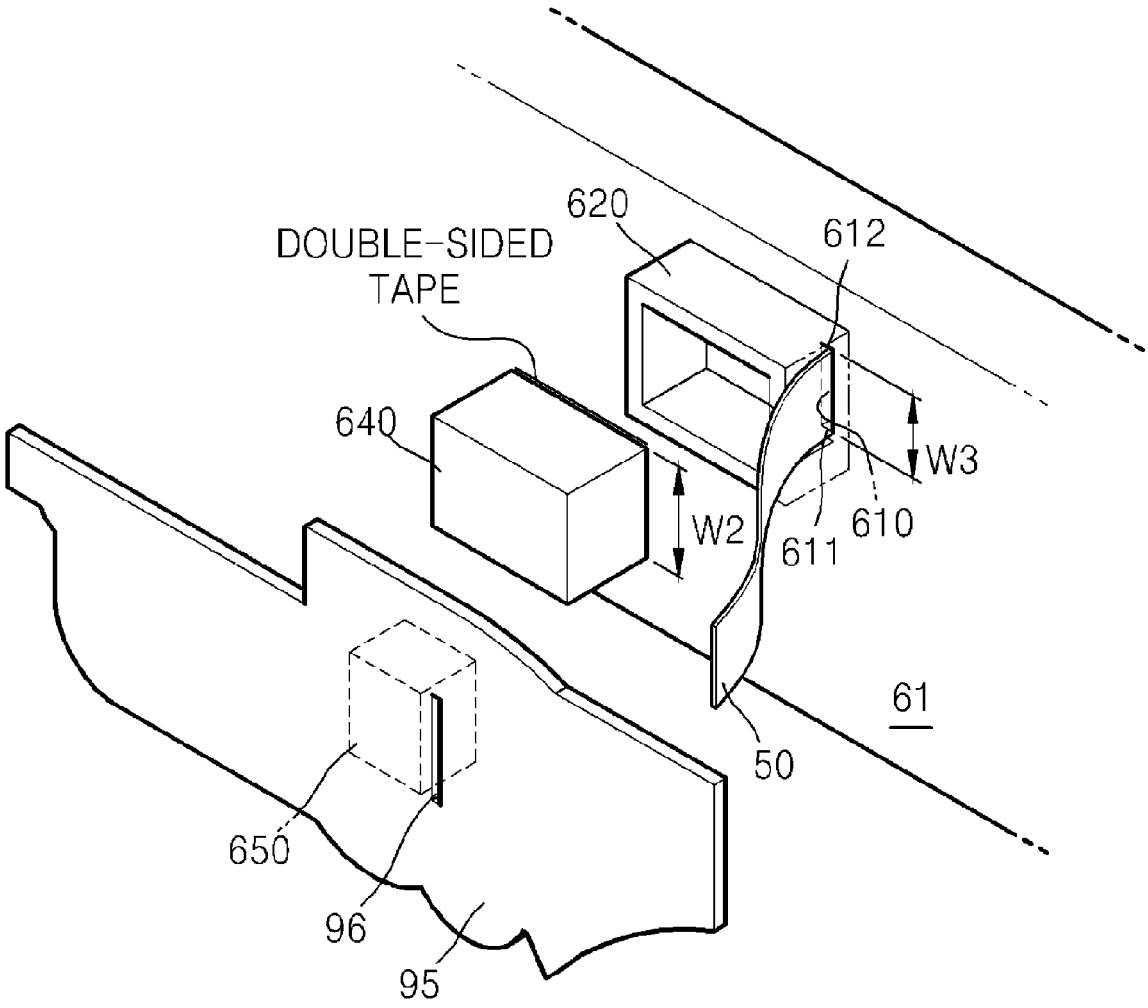
FIG. 12 is an exploded perspective view of a sealing unit that blocks the opening via which an end of the blocking film is exposed to the outside, according to an embodiment of the present general inventive concept.

When the lower frame 60 and the receiving frame 70 are combined via the side frame 95, an end of the blocking film 50 is exposed to the outside via a slit 96 illustrated in FIG. 12 of the side frame 95.

Figure 9:
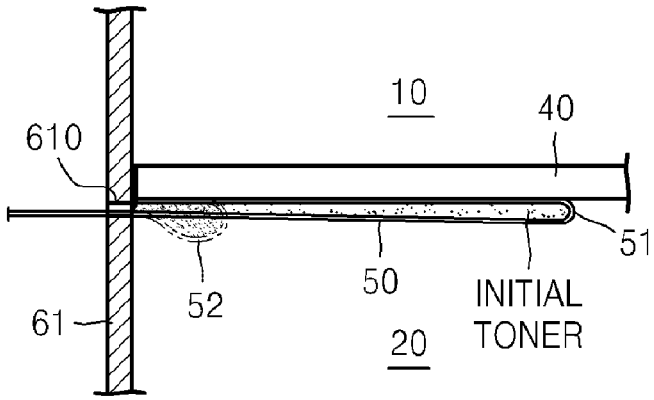
FIG. 9 is a plan view for describing how a blocking film included in the developing device of FIG. 1 is removed, according to an embodiment of the present general inventive concept.
Figure 10:
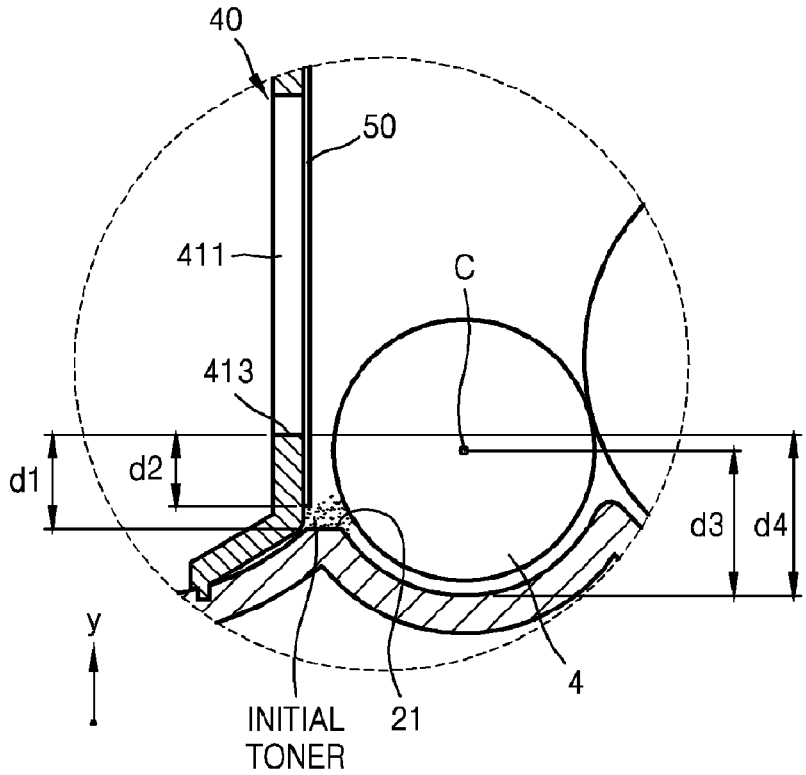
FIG. 10 is a diagram illustrating in detail a region E of FIG. 1, according to an embodiment of the present general inventive concept.

FIG. 9 is a plan view for describing how the blocking film 50 of FIG. 1 is removed, according to an embodiment of the present general inventive concept. FIG. 10 is a diagram illustrating in detail a region E of FIG. 1, according to an embodiment of the present general inventive concept. Referring to FIGS. 4 and 9, the attachment surface 421 to which the blocking film 50 is attached is a part of the barrier member 40, which faces the developing unit 20. If the blocking film 50 is attached to a part of the barrier member 40, which faces the toner container 10, then the toner in the toner container 10 is drawn by a curved portion 51 of the blocking film 50 toward the opening 610, thereby preventing the blocking film 50 from being easily removed.

In the developing unit 20, a small amount of toner (which is referred to as "initial toner") is contained in order to test the performance of the developing device 100 of FIG. 1 after the developing device 100 is manufactured. If the initial toner is drawn by the curved portion 51 of the blocking film 50 toward the opening 610 when the blocking film 50 is removed, then the blocking film 50 may not be easily removed while being inserted into the opening 610. That is, the initial toner is jammed between two folds of the blocking film 50 as marked by reference numeral 52 of FIG. 9, thereby preventing the blocking film 50 from being easily removed. In order to solve this problem, as illustrated in FIG. 10, a lower end 413 of each of the plurality of toner supply windows 411 is disposed to be higher than a bottom surface 21 of the developing unit 20. The lower end 413 of each of the plurality of toner supply windows 411 is disposed to be higher than a center C of the supply roller 4 in order to reduce an extent to which the initial toner contacts the blocking film 50. Accordingly, it is possible to reduce an amount of the initial toner drawn by the curved portion 51 toward the opening 610 when the blocking film 50 is removed and to prevent the blocking film 50 from being stuck due to the initial toner.

In other words, as illustrated in FIG. 10, a distance d1 between a lower end of the supply window 411 and the bottom surface 21 of the developing unit 20 may be greater than a distance d2 between the lower end of the supply window 411 and the lower end of the blocking film 50. In addition, the distance d3 in the vertical direction y between a center axis C of the supply roller 4 and the bottom surface 21 of the developing unit 20 may be less than a distance d4 in the y direction between the lower end of the supply window 411 and the bottom surface 21 of the developing unit.

Figure 11:
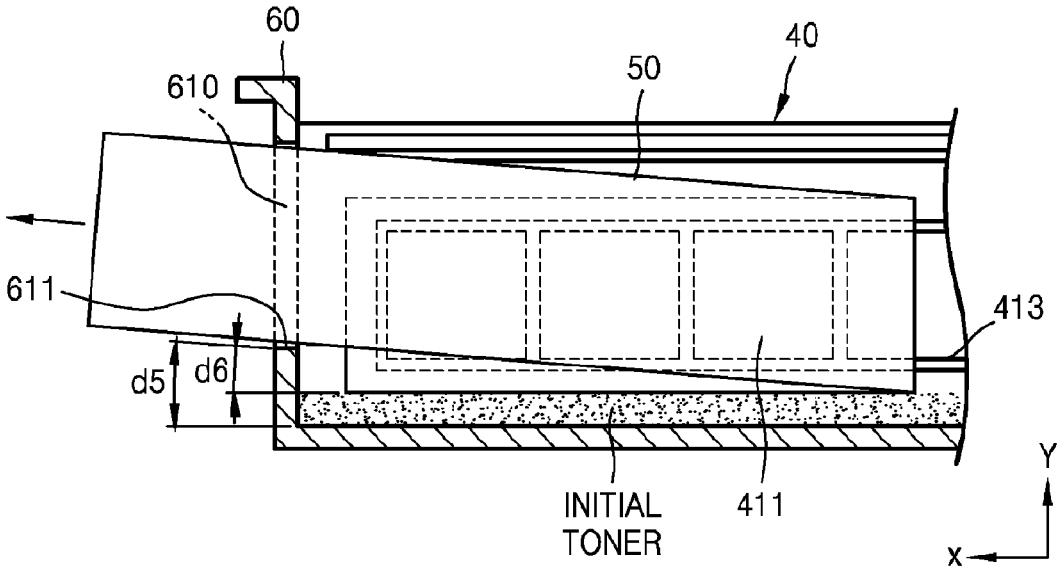
FIG. 11 is a front view illustrating the location of a plurality of toner supply windows and a opening via which an end of the blocking film is exposed to the outside, according to an embodiment of the present general inventive concept.

FIG. 11 is a front view illustrating the location of toner supply window 412 and the opening 610, according to an embodiment of the present general inventive concept. Referring to FIG. 11, a lower end 611 of the opening 610 may be disposed to be higher than the lower end 413 of the toner supply window 411 of the barrier member 40. In other words, a distance d5 in a vertical direction y between the lower end of the opening 610 and the bottom surface 21 of the developing unit 20 may be greater than a distance d6 between the lower end of the opening 610 and the lower end of the blocking film 50. In this case, the blocking film 50 is removed while being inclined with respect to a horizontal plane including a horizontal direction x, thereby preventing the initial toner from being moved by the curved portion 51 toward the opening 610. Even if a small amount of the initial toner is moved toward the opening 610, the moved toner is contained in a space lower than the lower end 611 of the opening 610, and thus, the blocking film 50 is not prevented from being removed due to the initial toner.

FIG. 12 is an exploded perspective view of a sealing unit 640 that blocks the opening 610, according to an embodiment of the present general inventive concept. Referring to FIG. 12, the first sidewall 61 of the lower frame 60 of FIG. 3 is combined with the sealing unit 640. The sealing unit 640 may be attached to the first sidewall 61 of the lower frame 60 using double-sided tape. The double-sided tape is disposed not to cover the opening 610. The sealing unit 640 cleanses toner stuck to the blocking film 50 when the blocking film 50 is removed. In order to prevent toner from leaking when the blocking film 50 is removed, the sealing unit 640 is fabricated such that a width W2 thereof is greater than a width W3 of the opening 610. The width W2 of the sealing unit 640 is determined so that the sealing unit 640 covers below the lower end 611 of the opening 610 and above an upper end 612 of the opening 610. For example, the width W2 of the sealing unit 640 may be determined so that the sealing unit 640 covers 0.7 mm or more away from the lower end 611 and away from the upper end 612 of the opening 610. A guiding rib 620 protrudes from the first sidewall 61, and guides the sealing unit 640 to be combined with the first sidewall 61 in order to cover below the lower end 611 and above the upper end 612 of the opening 610. The sealing unit 640 may be formed of an elastic foaming material such as foam rubber.

Also, a pressurizing unit 650 may further be installed to push the sealing unit 640 so that the sealing unit 640 is not separated from the first sidewall 61 when the blocking film 50 is removed. The pressurizing unit 650 may be disposed, for example, at an inner side of the side frame 95 that connects the lower frame 60 and the receiving frame 70 with each other. When the side frame 95 is combined with the lower frame 60 and the receiving frame 70, the pressurizing unit 650 presses the sealing unit 640 not to be separated from the lower frame 60. In this case, the pressurizing unit 650 presses a location on the sealing unit 640 close to the opening 610. If the pressurizing unit 650 presses a location on the sealing unit 640 closest to the opening 610, then the blocking film 50 is extremely firmly pressed by the sealing unit 640 and thus cannot be easily removed. For example, the pressurizing unit 650 may press a location on the sealing unit 640 about 0.5 mm to 1 mm away from the opening 610.

Figure 13:
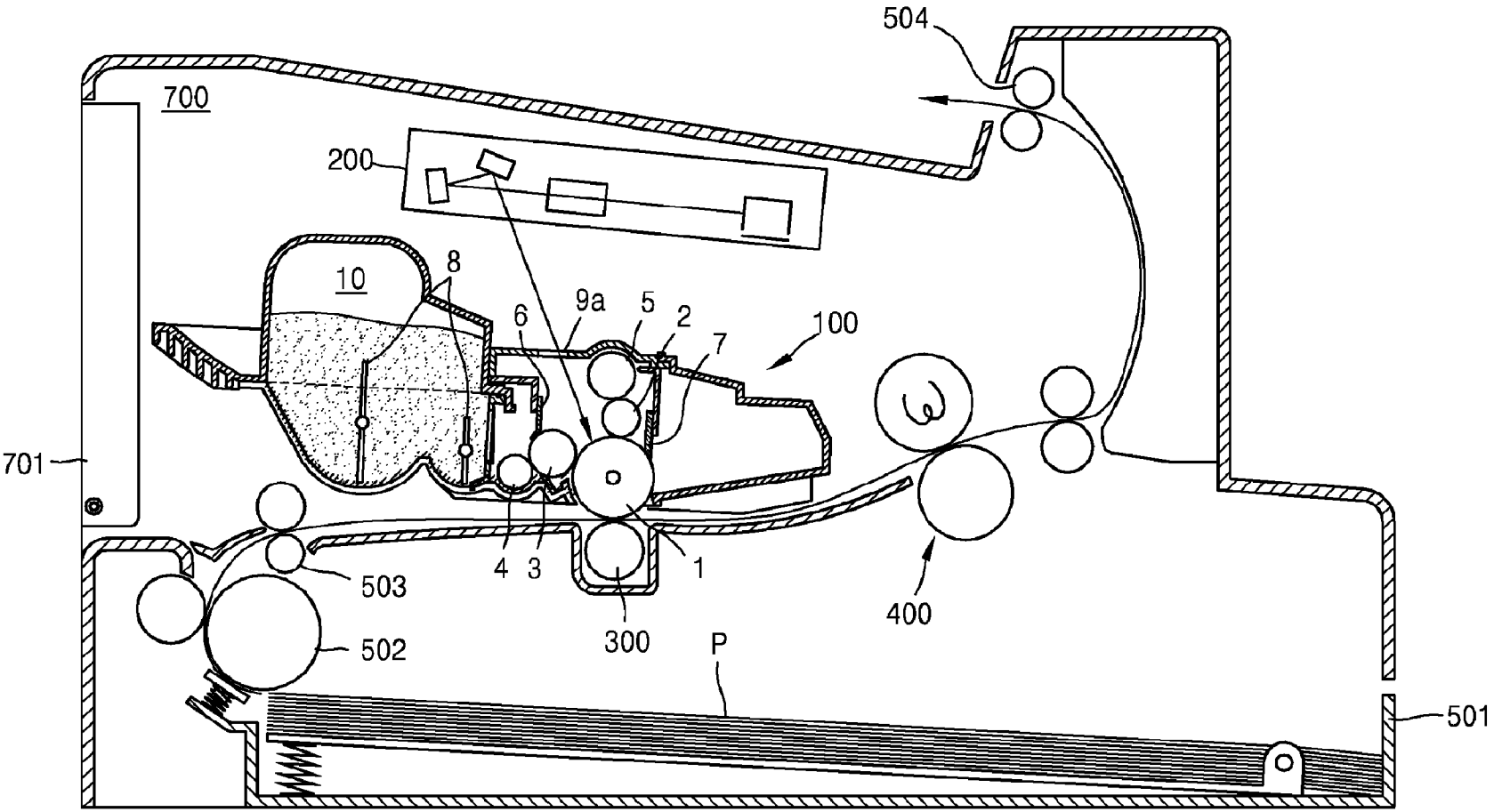
FIG. 13 is a schematic view showing the configuration of an electrophotographic image forming apparatus employing the developing device illustrated in FIGS. 1 to 12, according to an embodiment of the present general inventive concept.

FIG. 13 is a schematic view showing the configuration of an electrophotographic image forming apparatus employing the developing device 100 illustrated in FIGS. 1 to 12, according to an embodiment of the present general inventive concept. Referring to FIG. 12, the developing device 100 is inserted into a body 700 of the image forming apparatus through a door 701. The blocking film 50 is removed before inserting the developing device 100 into the body 700. Thus, the toner container 10 is connected to the developing unit 20 to supply toner to the developing unit 20.

The optical scanning unit 200 scans light, which is modulated according to image information, onto the photoconductive drum 1 which has been charged to a uniform potential. For example, a laser scanning unit (LSU) that scans light emitted from a laser diode onto the photoconductive drum 1 by deflecting the light in a main scanning direction by using a polygon mirror, may be used as the optical scanning unit 200.

The transfer roller 300, which is an example of a transfer device, is disposed to face a surface of the photoconductive drum 1, which is exposed through an opening 9*b*, in order to form a transfer nip. A transfer bias voltage is applied to the transfer roller 300 so as to transfer a toner image developed on the surface of the photoconductive drum 1 onto a recording medium P. A corona transfer device may be used instead of the transfer roller 300.

The toner image transferred onto the recording medium P by the transfer roller 300 remains adhered to the recording medium P due to electrostatic attraction. A fixing unit 400 applies heat and pressure onto the toner image in order to fix the toner image on the recording medium P, thereby forming a permanent printed image on the recording medium P.

A method of forming an image by using the electrophotographic image forming apparatus having the above configuration will now be briefly described. When a charging bias voltage is applied to the charging roller 2, the photoconductive drum 1 is charged to a uniform potential. The optical scanning unit 200 forms an electrostatic latent image on the photoconductive drum 1 by scanning light, which is modulated according to image information, onto the photoconductive drum 1 through the optical window 9*a* of the developing device 100. The toner contained in the toner container 10 is supplied to the development unit 20 by the agitator 8 and is then attached to the developing roller 3 by the supply roller 4. The regulator 6 forms a toner layer having a uniform thickness on the developing roller 3. A developing bias voltage is applied to the developing roller 3. The toner is moved to the development nip D as the developing roller 3 rotates and is then transferred and attached to the electrostatic latent image on the photoconductive drum 1, due to the developing bias voltage. Thus, a visible toner image is formed on the photoconductive drum 1. The recording medium P picked up from a recording medium tray 501 by a pick-up roller 502 is transported to the transfer nip between the transfer roller 300 and the photoconductive drum 1 by a transporting roller 503. When a transfer bias voltage is applied to the transfer roller 300, the toner image is transferred onto the recording medium P by electrostatic attraction. If the fixing unit 400 applies heat and pressure onto the toner image transferred onto the recording medium P, then the toner image is fixed to the recording medium P, thereby completing printing. The recording medium P is externally discharged by a discharge roller 504. Toner remaining on the surface of the photoconductive drum 1 which has not been transferred to the recording medium P is removed by the cleaning unit 7 and is collected in the waste toner container 30.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A developing device comprising:

a housing comprising a toner container containing toner, and a developing unit, wherein the developing unit comprises a developing roller and a photoconductive drum;

a barrier member comprising a toner supply window, wherein the barrier member is combined with the housing to separate the toner container and the developing unit from each other; and a blocking film that is attached to the barrier member to block the toner supply window, wherein an end of the blocking film is exposed outside the housing through an opening formed in a sidewall of the housing, wherein a bottom surface and first and second side surfaces of the barrier member are attached to a bottom surface and first and second side surfaces of the housing by using a welding process, and a distance between the first and second side surfaces of the barrier member and a distance between the first and second side surfaces of the housing increase from bottom to top.

2. The developing device of claim 1, wherein the first and second side surfaces of the barrier member are disposed at an angle of between about 75 and about 81 degrees with respect to a horizontal plane corresponding to the bottom surface of the barrier member.

3. The developing device of claim 1, further comprising a plurality of fusion protrusions protruding from the bottom surface and the first and second side surfaces of the barrier member, and fusion grooves formed in the bottom surface and the first and second side surfaces of the housing, into which the plurality of fusion protrusions are inserted, wherein an overlapping distance, constituting a measure of how much the fusion protrusions overlap the fusion grooves, respectively, is about 0.3 to about 0.5 mm.

4. The developing device of claim 1, wherein the blocking film is attached to an attachment surface of the barrier member, the attachment surface facing the developing unit.

5. The developing device of claim 1, wherein a lower end of the toner supply window is higher than a bottom surface of the developing unit.

6. The developing device of claim 5, wherein the developing unit comprises a supply roller to apply toner to the developing roller, and the lower end of the toner supply window is disposed to be higher than a center of the supply roller.

7. The developing device of claim 1, wherein the barrier member comprises a reinforcing rib having a multi-rib structure, the reinforcing rib being disposed on an upper portion of the toner supply window.

8. The developing device of claim 1, wherein the barrier member comprises a plurality of window reinforcement ribs crossing the toner supply window, wherein each of the window reinforcement ribs is disposed such that an upper surface of each of the window reinforcement ribs is lower than the attachment surface, thereby forming a step between each of the window reinforcement ribs and the attachment surface.

9. The developing device of claim 1, wherein a lower end of the opening is be higher than a lower end of the toner supply window.

10. The developing device of claim 1, further comprising an elastic sealing unit that is combined with the sidewall of the housing in which the opening is formed, to cover the opening.

11. The developing device of claim 10, wherein a length of the sealing unit is greater than a length of the opening.

12. The developing device of claim 10, further comprising a pressurizing unit pressing the sealing unit toward the sidewall of the housing.

13. The developing device of claim 12, wherein the housing comprises:

a lower frame forming a lower frame of both the toner container and the developing unit;

a receiving frame receiving remnant toner removed from the photoconductive drum; and a side frame that is combined with side surfaces of the lower frame and the receiving frame to connect the lower frame and the receiving frame, wherein the pressurizing unit is disposed at the side frame.

14. The developing device of claim 1, wherein the housing comprises:

a lower frame forming a lower structure of both the toner container and the developing unit; and an upper frame covering an upper portion of the lower frame, wherein a front end of the upper frame is fused with a top surface of the barrier member.

15. The developing device of claim 14, wherein a location at which the bottom surface of the barrier member is fused with the lower frame is disposed closer to the toner container than a location at which the top surface of the barrier member is fused with the front end of the upper frame.

16. An electrophotographic image forming apparatus comprising:

the developing device of claim 1;

an optical scanning unit to scan light, which is modulated according to an image signal, onto the photoconductive drum;

a transfer device to transfer a toner image formed on the photoconductive drum onto a recording medium; and a fixing unit to fix the toner image to the recording medium by applying heat and pressure to the recording medium.

17. The electrophotographic image forming apparatus of claim 16, wherein the first and second side surfaces of the barrier member are inclined at an angle between about 75 and about 81 degrees with respect to a horizontal plane corresponding to the bottom surface of the barrier member.

18. The electrophotographic image forming apparatus of claim 16, wherein a lower end of the toner supply window is higher than a bottom surface of the developing unit.

19. The electrophotographic image forming apparatus of claim 16, wherein a lower end of the opening is higher than a lower end of the toner supply window.

20. The electrophotographic image forming apparatus of claim 16, further comprising an elastic sealing unit that is combined with the sidewall of the housing in which the opening is formed, to cover the opening.

* * * * *